United States Patent [19]

Aprea et al.

[11] 4,252,276

[45] Feb. 24, 1981

[54] ADAPTER FOR NOZZLE TO PROVIDE A MODIFIED SPRAY PATTERN

[75] Inventors: George F. Aprea, Dedham; Werner P. Pohle, Lynn, both of Mass.

[73] Assignee: Wm. Steinen Mfg. Co., Parsippany, N.J.

[21] Appl. No.: 82,714

[22] Filed: Oct. 9, 1979

[51] Int. Cl.[3] ..... B05B 1/02

[52] U.S. Cl. ..... 239/391; 239/499; 239/601; 239/DIG. 1

[58] Field of Search ..... 239/390, 391, 397, 499, 239/600, 601, 596, DIG. 1

[56] References Cited

U.S. PATENT DOCUMENTS 2,388,093 10/1945 Smith ..... 239/394

2,676,841 4/1954 Pohle ..... 239/499 X

FOREIGN PATENT DOCUMENTS 324169 10/1904 France ..... 239/596

*Primary Examiner*—Andres Kashnikow

*Attorney, Agent, or Firm*—Ostrolenk, Faber, Gerb & Soffen

[57] ABSTRACT

An adapter to be fitted over the orifice of a nozzle the configuration of whose output it is desired to modify has a central bore aligned with the orifice of the nozzle. A shallow recess is provided in the output end of the adapter surrounding the orifice of its bore. The perimeter of the recess has the shape to be imparted to the nozzle output.

2 Claims, 9 Drawing Figures

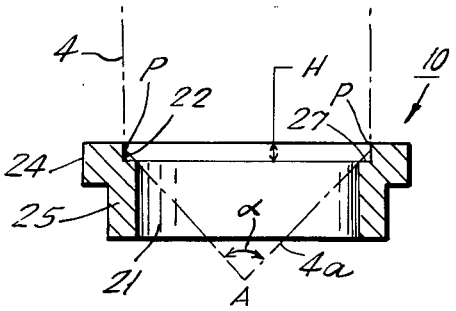
FIG. 7a.
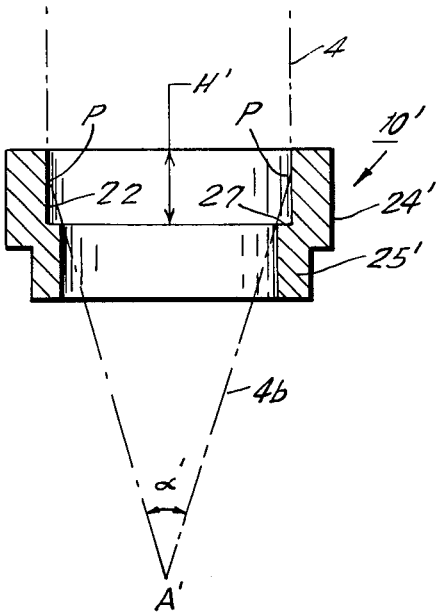
FIG. 7b.
FIG. 6.
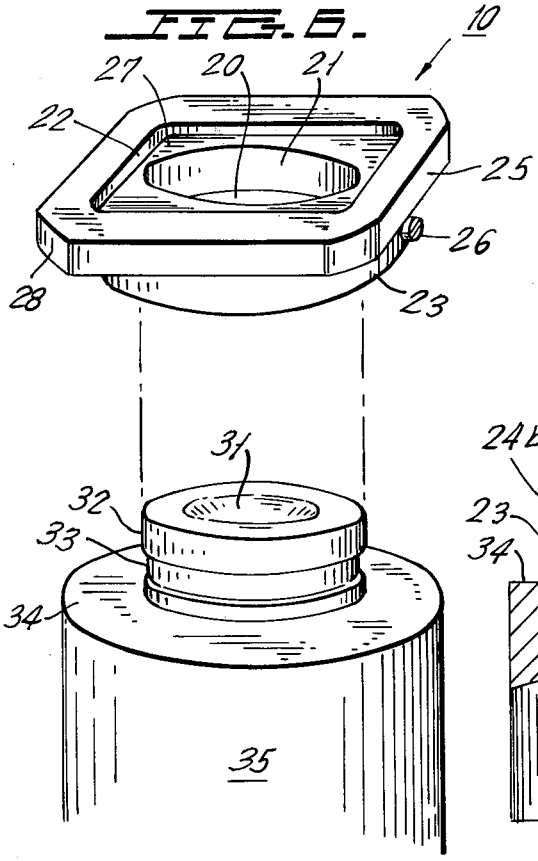
FIG. 5.
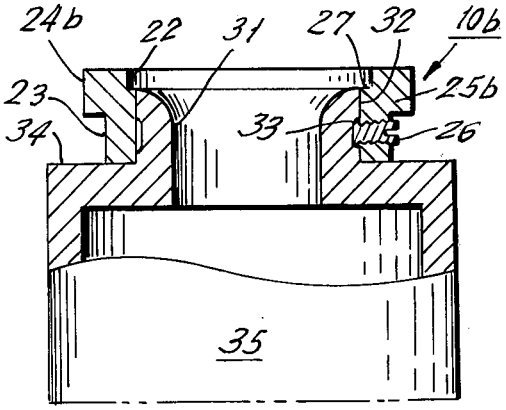

ADAPTER FOR NOZZLE TO PROVIDE A MODIFIED SPRAY PATTERN

BACKGROUND OF THE INVENTION

This invention relates generally to nozzle systems of the type that produce a wide angle spray output of 90° to 150° having a cross-section of a given shape centered on the axis of the nozzle system. More particularly, this invention relates to an adapter for use with ordinary nozzles of the type that produce a wide angle conical output spray, in order to convert their output to one having a cross-section of a chosen shape.

In a number of industrial and other applications, it is desirable to have a nozzle the output of which is of a special shape, e.g. rectangular, oval or annular rather than circular, in cross-section. Spray nozzles to produce a given spray shape cannot now be used to produce any other spray configuration. Thus a user must have numerous separate nozzles in inventory in order to be able to produce any of a number of different spray patterns. Moreover, if a user wishes to change a particular spray pattern, he must now replace the entire nozzle assembly. It would be very desirable to have a device with which to easily and inexpensively convert an ordinary nozzle having one output shape into a nozzle having an output of a different shape since this could reduce inventory costs and operating costs when spray shapes must be changed.

SUMMARY OF THE INVENTION

It is the principal object of the present invention to remedy the defects of the prior art by means of providing an inexpensive and easy-to-manufacture adapter which can be easily attached to a conventional nozzle with a conical output spray to produce an output spray with cross-section of a given shape.

It is a further object of the present invention to provide such an adapter that can be easily and conveniently removed from a nozzle as required.

It is yet a further object of the present invention to provide an adapter adjustable in such a manner that the orientation of its e.g. rectangular spray output can be varied as needed.

In one embodiment, the adapter of the present invention fits snugly over the end of a conventional conical output nozzle. A wall having the shape to be imparted to the spray is positioned parallel to the nozzle output axis and just exterior of the nozzle orifice such that a fluid leaving the orifice of the nozzle impinges on the wall at an angle and is thereby redirected into a configuration whose cross-section is the shape of the wall.

This and other features and advantages of the present invention will become clearer upon consideration of the following detailed description of the invention, taken in conjunction with the accompanying Figures.

BRIEF DESCRIPTION OF THE DRAWINGS

Like reference numerals refer to like elements in the various embodiments shown in the Figures, in which:

FIG. 5 shows a side view, partly in section and taken in the line and direction of the arrows 5—5 of FIG. 3, of one embodiment of the adapter of the present invention in place of a nozzle;

FIG. 6 shows an exploded perspective view of the embodiment of the adapter of FIG. 3 and a nozzle with which it can be used;

FIGS. *7a* and *7b* show side views in section of two embodiments of the adapter of the present invention.

DETAILED DESCRIPTION OF THE INVENTION

Figure 1:
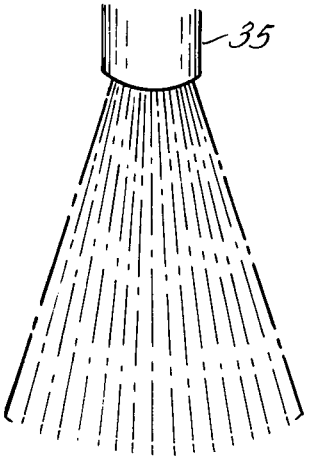
FIG. 1. PRIOR ART
FIG. 1 shows a conventional nozzle without adapter and producing a conical spray.
Figure 2:
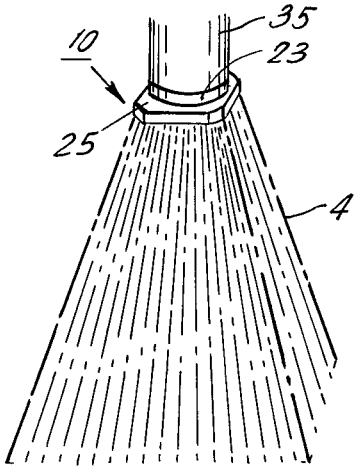
FIG. 2 is a perspective view of the adapter according to the invention attached to a conventional nozzle and in use.

FIG. 1 shows a nozzle 35 without the adapter of the invention, producing a conical spray. In FIG. 2, the adapter 10 of the present invention is shown in use in conjunction with a nozzle 35 of the type having a conical output. The adapter 10 has a cylindrical portion 23 by means of which it is attached to the nozzle 35 and a shaping portion 25, which performs the work of imparting a square configuration 4 to the conical output of the nozzle 35.

Figure 3:
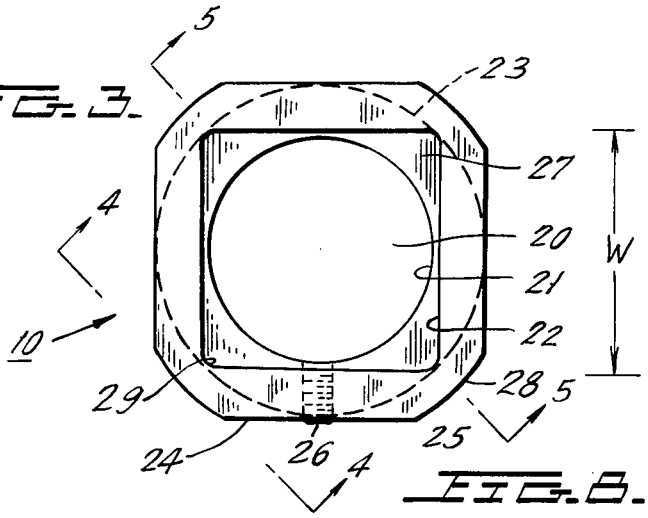
FIG. 3 shows an elevational top view of one preferred embodiment of the adapter of the present invention.
Figure 4:
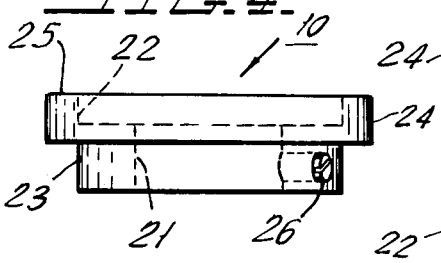
FIG. 4 shows a side elevational view taken in the direction of the arrows 4—4 of the embodiment of FIG. 3.

FIGS. 3 and 4 show top and side elevational views of one preferred embodiment of the adapter of the invention. The lower cylindrical portion 23 of the adapter is provided with an internal bore 21 that fits tightly over the conventional nozzle 35 (FIGS. 5 and 6) with which the adapter is to be used. A screw 26 is provided in the wall of cylindrical portion 23 perpendicular to the bore 21 to engage the groove 33 in nozzle 35 and make the attachment to it more secure. Coaxial with the cylindrical lower part 23 of the adpater is the upper part 25, which the bore 21 extends all the way through. Recessed into the upper surface of the upper part 25 of the adapter 10 is a shelf 27 slightly wider in its smallest dimension w than the width of the bore 21 and having the configuration to be imparted to the spray, square in this embodiment. The shelf 27 is coaxial with the bore 21, and its corners 29 are slightly rounded.

FIGS. 5 and 6 show the adapter 10 of the embodiment of FIG. 3 in relation to a nozzle 35 suitable for use with it. The adapter 10 of the present invention fits over the end 32 of the nozzle 35, and screw 26 of the adapter is tightened to engage groove 33 on the nozzle as described above. In this position, the orifice 31 of the nozzle is aligned coaxially with the bore 21 of the adapter 10, as shown more clearly in the sectional view of FIG. 5.

Normally, the circular orifice 31 will produce a spray pattern which is circular in cross-section. However, with the adapter 10 in place, the walls 22 surrounding the shelf 27 are close enough to the bore 21 that when the stream passes through the adapter 10 and begins to spread out, it strikes the walls 22 and, as is well-known, is forced to conform to the shape of the wall 22. With a high-volume nozzle having a two-inch mixing chamber and a one-inch orifice, a square spray has been obtained subtending an angle $\alpha$ (see FIG. *7a*) of 80°, at a water pressure of 40 psi and a flow rate of 100 gallons/minute, or an angle of 99° at the same pressure but with a flow rate of 92 gallons/minute.

FIGS. 7*a* and *b* show two embodiments 10, 10' of the adapter for use with nozzles having conical outputs subtending different angles $\alpha$, $\alpha'$. Adapter 10 of FIG. 7*a*, which is for use with a nozzle that produces a spray having the form of a wide cone 4*a* with its apex at A and subtending an angle of $\alpha$, has a shelf 27 bounded by relatively shallow walls 22, of a height H. A generally similar adapter 10' is shown in FIG. 7*b*, for use with a nozzle whose conical output subtends an angle $\alpha'$ and has its apex at A'. In order to ensure that the stream of fluid does not miss the wall 22' of the shelf 27', the wall 22' has a greater height H' then in the embodiment of FIG. 7*a*. If angle $\alpha$ is 90° and the diameter of the bore 21 is one inch, for example, the necessary wall height H is $\frac{1}{8}$ inch. If the angle $\alpha'$ is 45° (due, for example, to the bore's having a diameter of only $\frac{1}{2}$ inch), the required wall height H' is greater than $\frac{1}{8}$ inch.

Figure 8:
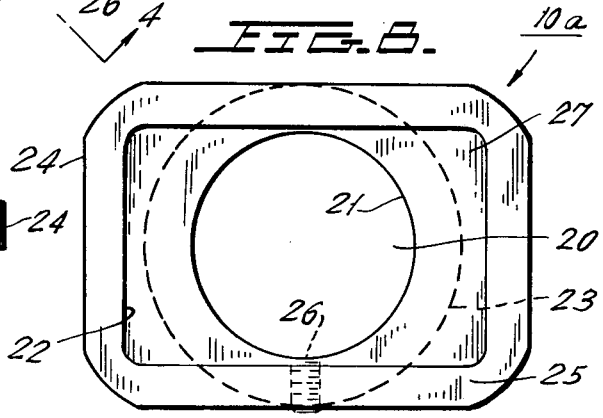
FIG. 8 shows an elevational top view of another embodiment of the adapter according to the invention.

In the embodiment of the invention shown in FIG. 8 the shelf 27 is oblong rather than square as in FIG. 3. Like elements in FIGS. 3 and 8 have the same reference numerals. This design produces a spray of oblong configuration. Any shape could be imparted to the spray by means of a shelf 27 having the shape to be imparted to the spray, provided that the greatest dimension of the shelf 27 is not too large compared to the diameter of the bore 21.

It should be noted that in the embodiments of FIGS. 3 and 8, the outer perimeter 24 of the upper portion 25 of the adapter 10 has generally the same shape as the wall 22 surrounding the shelf 27 except for having more broadly rounded corner regions 28. Each straight side of the outer perimeter 24 is parallel to the nearest portion of the inner perimeter 22. This feature makes it especially easy to determine the angular orientation of the adapter with respect to the nozzle. Furthermore, the rectilinear lines of the outer perimeter 24 of the adapter 10, 10*a* make it easy to grasp it to adjust that angular orientation.

An adapter according to the present invention could be made with the perimeter of the shelf of any desired shape, in order to convert a conical spray into a spray of any desired configuration.

Although the present invention has been described in detail in conjunction with several preferred embodiments, many modifications and variations thereof will now be apparent to one skilled in the art, and the scope of the invention is therefore to be limited not by the details of the description contained herein, but only by the terms of the appended claims.

What is claimed is:

1. A spray nozzle adapter for converting a given spray pattern of a nozzle to a different spray pattern; said spray nozzle adapter comprising a unitary integral body having a neck portion connectable to a spray nozzle to be coaxial therewith; said adapter further having a spray shaping portion comprising a flat platform disposed perpendicular to the axis of said neck portion and a peripheral wall portion enclosing said flat platform and extending in a direction away from said neck portion; said peripheral wall portion being symmetric about an axis of said neck portion; the interior wall of said wall portion having the shape which defines the shape of said different spray pattern.

2. The spray nozzle adapter of claim 1, wherein said different spray pattern is rectangular in cross-section.

* * * * *